United States Patent [19]

Morse et al.

[11] 4,052,931

[45] Oct. 11, 1977

[54] METHOD AND APPARATUS FOR LINING CONTAINERS

[75] Inventors: Hugh B. Morse, San Jose; Robert B. Johnson, Santa Clara; Helmut E. W. Masch, San Jose, all of Calif.

[73] Assignee: Helmut E. W. Masch, San Jose, Calif.

[21] Appl. No.: 726,269

[22] Filed: Sept. 24, 1976

[51] Int. Cl.[2] ..... B31B 7/74

[52] U.S. Cl. ..... 93/36.01; 53/175

[58] Field of Search ..... 93/36.01, 36 R, 36.6, 93/84 FF; 53/175

[56] References Cited

U.S. PATENT DOCUMENTS

| | | | |
|---|---|---|---|
| 2,162,263 | 6/1939 | Lindholm et al. | 53/175 X |
| 2,364,012 | 11/1944 | Walton et al. | 53/175 X |
| 3,387,427 | 6/1968 | Perdue | 53/175 X |

*Primary Examiner*—James F. Coan
*Attorney, Agent, or Firm*—Phillips, Moore, Weissenberger, Lempio & Majestic

[57] ABSTRACT

A bag-type liner is applied interiorly of a container, such as a corrugated carton or box, by inserting an open end of the liner over an open end of the container and thereafter creating a vacuum within the container and liner to simultaneously draw the liner within the container. In a first apparatus embodiment of this invention, the vacuum is created by moving a partially opened bottom of the container over a vacuum opening formed in the platen. In a second apparatus embodiment of this invention, a pair of vacuum plenums are movably mounted adjacent to sides and upper portions of the container to draw the vacuum over and between upper closure flaps connected to the container.

18 Claims, 3 Drawing Figures

METHOD AND APPARATUS FOR LINING CONTAINERS

BACKGROUND OF THE INVENTION

A plastic liner or the like is oftentimes employed in a shipping carton or box to retain foodstuffs or other commodities in a fresh condition therein. The liner is usually in bag form and is manually inserted into the carton by a workman. Such a manual method of applying the liner interiorly of the carton is laborious and time consuming. In addition, a workman having a low degree of dexterity may find it difficult to place the liner in its proper position within the carton to fully cover the interior walls thereof and to avoid any undesirable wrinkles or folds in the liner.

SUMMARY OF THE INVENTION

An object of this invention is to provide improved and economical method and apparatus for expeditiously applying a liner interiorly of a carton with a high degree of quality control. The open end of a bag-type liner is inserted over an open end of the container and a pressure is created in the container and liner which is less than the ambient pressure exteriorly thereof. Thus, the liner is drawn into the container to provide a composite shipping carton or box adapted to retain foodstuffs or other commodities in a sealed condition therein.

A first apparatus embodiment of this invention for carrying forth the above method comprises an elongated platen having an opening formed thereon to expose a partially opened bottom of the container to a negative pressure or vacuum. In a second such embodiment, a pair of plenums are movably mounted adjacent to a platen or conveyor to move into substantial sealing relationship with sides and top portions of the container to draw the vacuum over and between top closure flaps connected to the container.

BRIEF DESCRIPTION OF THE DRAWINGS

Other objects of this invention will become apparent from the following description and accompanying drawings wherein.

DETAILED DESCRIPTION

Figure 1:
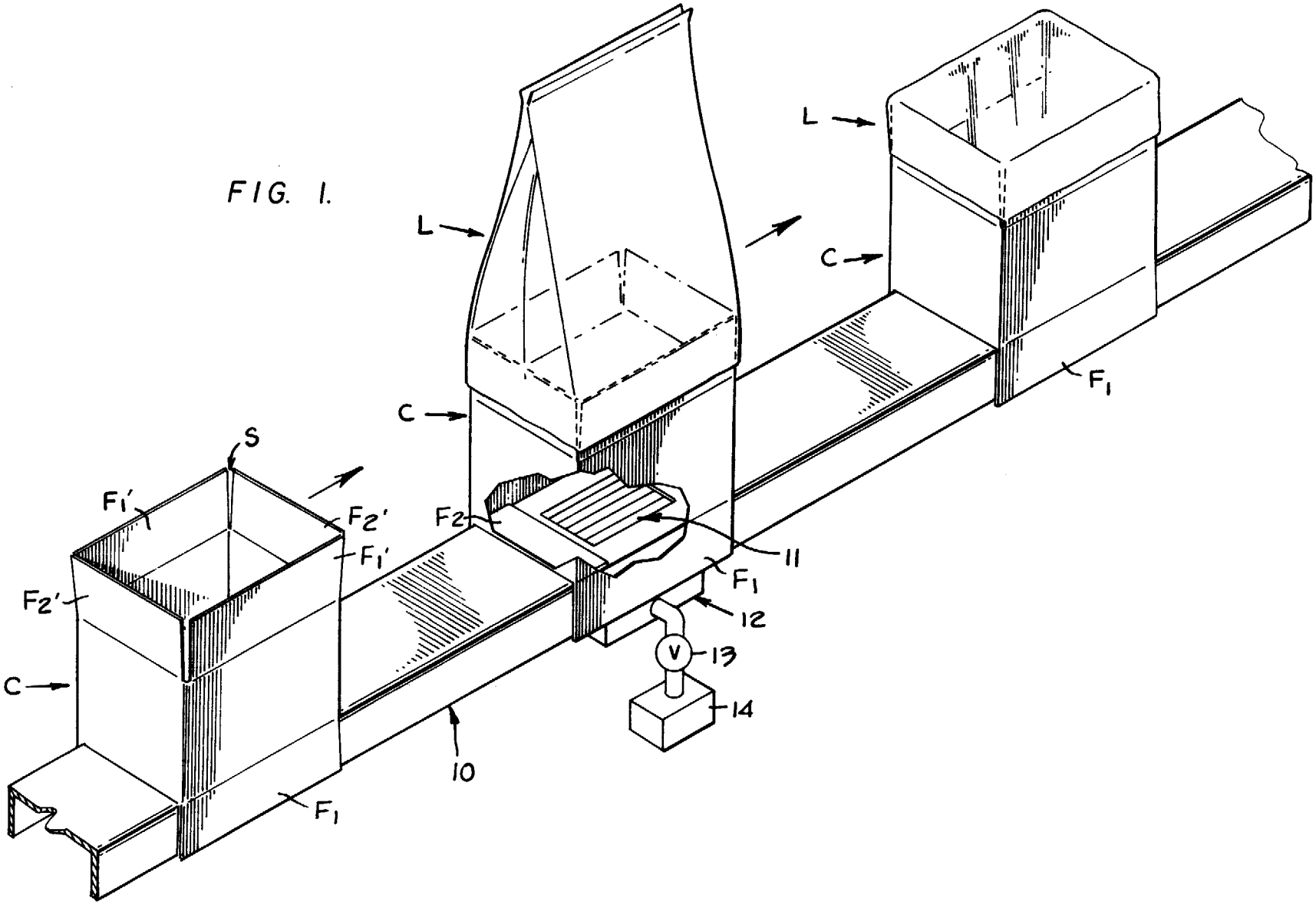
FIG. 1 is an isometric view illustrating a first apparatus embodiment of this invention for applying a liner interiorly of a container and further illustrating sequential steps to effect the same.

Referring to FIG. 1, a stationary and horizontally disposed platen 10 has a rectangular opening or grid 11 formed thereon. A vacuum box or plenum 12 is secured beneath the platen and communicates with opening 11 to create a negative pressure or vacuum thereat which is less than ambient pressure for purposes hereinafter explained. A standard valve 13 may be operatively interconnected between plenum 12 and a vacuum source 14, such as a suitable pump, to create the vacuum at opening 11 in a conventional manner.

In carrying forth the method steps of this invention, a container C is mounted on platen 10 to have a pair of side closure flaps $F_1$ mounted in straddling relationship relative to the platen. A pair of end closure flaps $F_2$, (one shown) are folded inwardly into superimposed relationship over the platen to define an opening therebetween. Flaps $F_1$ and $F_2$ are thus adapted to be folded and glued together to form the bottom closure of the carton whereas corresponding top closure flaps $F_1'$ and $F_2'$ are adapted to form the top closure of the container. The container may comprise a standard paperboard carton or corrugated box of the standard type which is suitably cut and scored as a one-piece blank to form the illustrated end and sidewalls and attached closure flaps.

The first step in carrying forth the method of this invention is one of inserting an open end of a bag-type liner L over the top open end of container C. Although the liner is preferably plastic, it could comprise a thin paper-based material. The liner extends sufficiently down over the outside of the container to cover the four slots or openings S, each defined at a corner of the container between an adjacent pair of top closure flaps $F_1'$ and $F_2'$. The container, with the liner mounted thereon, is then moved on platen 10 and over opening 11.

The workman then actuates valve 13 by a foot pedal, for example, to communicate vacuum source 14 with plenum 12. Thus, a pressure is created within the container and the liner which is less than the ambient pressure exteriorly thereof to simultaneously draw the liner downwardly into the container. It should be understood that container C can be moved manually along platen 10 or, alternatively, a suitable conveyor could be utilized to semi-automate the process.

A further shown in FIG. 1, the container is then moved past opening 11 whereafter the container is moved through a standard folding and gluing station (not shown) to apply a suitable pattern of glue to bottom closure flaps $F_1$ and thereafter fold them inwardly and secure them to flaps $F_2$. The container with the liner in place can be filled with foodstuffs or other types of commodities whereafter the upper end of the liner can be stripped off upper closure flaps $F_1'$ and $F_2'$. The open end of the liner can be suitably sealed or tied and inserted within the container whereafter the container can move through a second folding and gluing station to fold and secure the top closure flaps together.

Figures 2, 3:
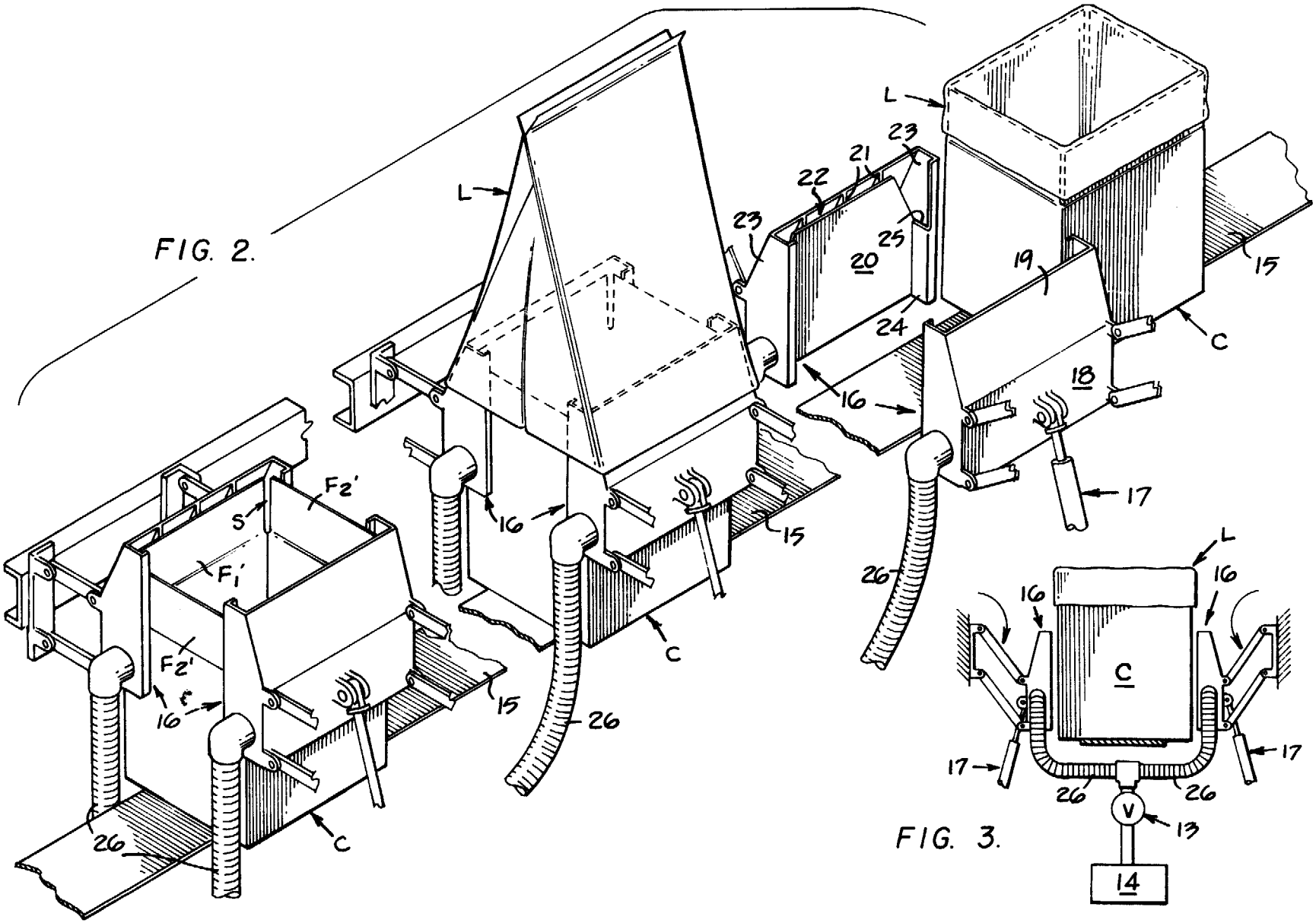
FIG. 2 is a view similar to FIG. 1, but illustrating a second apparatus embodiment of this invention.
FIG. 3 is a transverse section through the FIG. 2 apparatus and further illustrating a control system therefor.

FIG. 2 illustrates a second apparatus embodiment and modified method of this invention. The apparatus comprises an intermittently operated conveyor 15 for moving each container C in the direction of the illustrated arrows to apply liner L within the container. A pair of plenums 16, mounted on either side of the container, are adapted to draw a vacuum therein, as will be hereinafter more fully described.

Each plenum is adapted to be moved between its lower inoperative position and its upper operative position, illustrated in FIG. 2, by suitable actuating means, such as a standard double-acting air cylinder 17 connected thereto. The plenum may be formed out of suitable sheet metal stampings to comprise an outer sidewall 18 having an upper wall portion 19 tapered upwardly and inwardly relative to a flat inner sidewall 20 to facilitate insertion of the open end of liner L thereover. A plurality of vertically disposed reinforcing ribs 21 may be secured between walls 18 and 20, if so desired, and an evacuating chamber 22 is defined therebetween.

A pair of outer end walls 23 are secured to opposite ends of outer sidewall 18 whereas a pair of inner end walls 24 (one shown) are secured to opposite ends of inner sidewall 20. The upper edge of inner sidewall 20 preferably terminates short of the upper edge of outer sidewall 18 to define an outlet opening communicating with chamber 22 and a common notch 25 is defined at the juncture of inner sidewall 20 and each inner end wall 24. The plenum is generally U-shaped when viewed in cross section and walls 20 and 24 thereof are suitably sized to substantially conform to the length of the container, between closure flaps $F_2'$, to straddle the container and flaps for purposes hereinafter described.

Chamber 17 of each plenum is connected to valve 13 and vacuum source 14 by means of a flexible conduit 26. Thus, the flexible conduit will permit the plenum to move between its inoperative and operative positions. FIG. 2 further illustrates the sequential steps utilized by the apparatus to effect the method steps of this invention, which will now be described.

Initially, the bottom closure flaps of the carton are folded and secured together by passing the container through a standard folding and gluing station (not shown). Conveyor 15 is then moved under intermittent control of the operator to move container C to its first position depicted by the first illustration in FIG. 2. Plenums 16 are then moved upwardly to their illustrated operative positions by suitable control means (not shown) manipulated by the workman to extend cylinders 17 (one shown).

As shown in the second or intermediate illustration in FIG. 2, the workman then inserts an open end of liner L over the open end of container C. The liner will envelope tapered upper wall portions 19 of the plenums and also substantially envelope top closure flaps $F_1'$ and $F_2'$. Upon actuation of valve 13 by the workman, a pressure is created within the container which is less than the ambient pressure exteriorly thereof, i.e., a negative pressure or vacuum, to simultaneously draw the liner within the container.

As clearly shown in FIG. 2, evacuating chamber 22 of each plenum is exposed interiorly of the carton over the top edges of upper closure flaps $F_1'$ and over adjacent portions of the top edges of upper closure flaps $F_2'$. In addition, the negative pressure or vacuum communicates interiorly of the container via notches 25 and slots S, defined between each adjacent pair of top closure flaps $F_1'$ and $F_2'$. The "radius" of the liner, adjacent to each slot, is greater than the "radius" defined by the corner of the container between flaps $F_1'$ and $F_2'$ to provide a sufficiently large passage therebetween to communicate the slot interiorly of the container.

The workman then retracts cylinders 17 to move plenums 16 downwardly and away from the container, as illustrated in the third illustration in FIG. 2. The control means (not shown) for moving conveyor 15 is then actuated to move a second container in position for the liner applying process. The container can then be filled and the liner closed and inserted in the sealed container, as described above.

We claim:

1. A method for applying a bag-type liner interiorly of a container comprising the steps of inserting an open end of said liner over an open end of said container, and creating a pressure within said container from a top portion thereof and within said liner which is less than ambient pressure exteriorly thereof and simultaneously drawing said liner within said container.

2. The method of claim 1 wherein said container comprises upstanding closure flaps connected to an upper end thereof and wherein said inserting step comprises inserting said liner in enveloping relationship exteriorly of said closure flaps.

3. The method of claim 1 wherein said container comprises a pair of sidewalls and a pair of end walls and a bottom closure flap connected to each of said end and sidewalls and further comprising the step of folding all of said flaps into superimposed relationship prior to said step of creating a pressure within said container.

4. The method of claim 2 further comprising the step of moving said container on a conveyor.

5. The method of claim 1 wherein said creating step comprises moving at least one plenum adjacent to an upper portion of said container and creating said pressure within said plenum and communicating said pressure interiorly of said container and said liner.

6. The method of claim 5 wherein said creating step comprises moving a said plenum adjacent to each side of said container and into straddling relationship relative to ends thereof.

7. The method of claim 6 wherein said container comprises a pair of end walls and a pair of sidewalls each having a top closure flap connected thereto and wherein said creating step comprises communicating said pressure over top edges of the closure flaps connected to said side panels.

8. The method of claim 7 wherein said creating step further comprises communicating said pressure within said container through a slot formed between each adjacent pair of flaps connected to a respective one of said end walls and a respective one of said sidewalls.

9. A method for applying a bag-type liner interiorly of a container comprising a pair of sidewalls and a pair of endwalls and a closure flap connected to an upper end of each of said sidewalls and endwalls, comprising the steps of positioning said closure flaps in upstanding relationship on said container, inserting an open end of said liner in enveloping relationship exteriorly over said closure flaps, and creating a pressure within said container and said liner which is less than ambient pressure exteriorly thereof and simultaneously drawing said liner within said container and over interior surfaces of said closure flaps while maintaining open end portions of said liner exteriorly of said closure flaps.

10. An apparatus for applying a bag-type liner interiorly of a container comprising first means for supporting said container, and second means movably mounted adjacent to said first means for movement between a lowered inoperative position and a raised operative position adjacent to a top portion of said container for creating a pressure within said container and said liner which is less than ambient pressure exteriorly thereof whereby said liner will be drawn into said container.

11. The apparatus of claim 10 wherein said second means comprises at least one plenum mounted adjacent to said first means and means for selectively creating said pressure within said plenum.

12. The apparatus of claim 12 wherein said plenum is generally U-shaped in cross section.

13. The apparatus of claim 12 wherein said plenum is movably mounted adjacent to said first means for movement between said lowered inoperative position and said raised operative position adjacent to the top portion of said container.

14. The apparatus of claim 13 further comprising actuating means for selectively moving said plenum between its lowered inoperative position and its raised operative position.

15. The apparatus of claim 12 wherein a said plenum is mounted adjacent to each side of said first means.

16. The apparatus of claim 12 wherein said plenum comprises outer and inner walls defining a chamber therebetween and within said plenum.

17. The apparatus of claim 16 wherein an upper edge of said inner wall terminates short of an upper edge of said outer wall to define an opening therebetween communicating with the chamber defined in said plenum.

18. The apparatus of claim 17 wherein said plenum further comprises a pair of end walls each secured between adjacent ends of said inner and outer walls and a notch defined at each corner of said inner wall and end walls to define an opening communicating with said chamber on each lateral end of said plenum.

* * * * *